US008566964B1

(12) United States Patent
Acosta

(10) Patent No.: US 8,566,964 B1
(45) Date of Patent: Oct. 29, 2013

(54) MEDICAL ACCESS SHIRT

(76) Inventor: John Acosta, Shreveport, LA (US)

( * ) Notice: Subject to any disclaimer, the term of this patent is extended or adjusted under 35 U.S.C. 154(b) by 224 days.

(21) Appl. No.: 13/066,813

(22) Filed: Apr. 26, 2011

(51) Int. Cl.
*A41B 9/00* (2006.01)
*A41D 10/00* (2006.01)

(52) U.S. Cl.
USPC ..... 2/114

(58) Field of Classification Search
USPC ..... 2/114, 69, 77, 104, 106, 113, 115; 40/586
See application file for complete search history.

(56) References Cited

U.S. PATENT DOCUMENTS 1,582,385 A * 4/1926 Dauphinais ..... 2/114
1,998,051 A * 4/1935 Gerber ..... 2/114
2,038,280 A 4/1936 Goldstein
2,303,383 A 12/1942 Norton
2,319,089 A 5/1943 Severance
2,527,258 A * 10/1950 Kahn ..... 40/586
3,276,036 A * 10/1966 Cater et al. ..... 2/114
4,383,335 A * 5/1983 Slocum ..... 2/114
4,422,186 A 12/1983 Loney
4,570,268 A 2/1986 Freeman
5,133,086 A 7/1992 Truitt et al.
D336,968 S * 7/1993 Russano ..... D2/720
5,572,742 A * 11/1996 McFadden ..... 2/114
6,216,271 B1 4/2001 Chen
6,272,685 B1 * 8/2001 Kumar ..... 2/114
6,647,552 B1 * 11/2003 Hogan ..... 2/114
D491,340 S * 6/2004 Gorman ..... D2/728
6,792,622 B2 9/2004 Graves
7,305,716 B1 12/2007 Richards
7,454,798 B2 * 11/2008 Feodoroff ..... 2/114
2003/0126668 A1 7/2003 Scroggins
2004/0010837 A1 1/2004 Graves
2005/0015127 A1 * 1/2005 Bieberich ..... 607/108
2010/0050315 A1 3/2010 Christou-Kelly et al.

* cited by examiner

*Primary Examiner* — Amber Anderson
(74) *Attorney, Agent, or Firm* — R. Keith Harrison

(57) ABSTRACT

A medical access shirt includes a shirt body having a pair of front shirt panels and a rear shirt panel carried by the front shirt panels and a generally elongated, rectangular rear shirt panel opening in the rear shirt panel.

17 Claims, 4 Drawing Sheets

MEDICAL ACCESS SHIRT

FIELD

The disclosure generally relates to medical garments worn by medical patients in a clinical or hospice setting. More particularly, the disclosure relates to a medical access shirt which enhances medical access to a clinical or hospice patient while giving the patient a styled or dressed appearance.

BACKGROUND

Conventional medical garments typically include a lightweight short-sleeved cotton or polyester gown which is placed over the patient's arms and covers the front and sides of the patient. The gown may include a strap which can be tied to secure the gown over the backside of the patient. The medical garments enable medical personnel easy access to the patient for insertion of intravenous tubing and cleaning and the like while affording the patient a measure of dignity.

Terminal patients are often confined to a hospice facility in their final days. Such patients may be required to take painkillers or other medication by intravenous drip. These patients may also require regular cleaning by a hospice caregiver. Terminal patients are often visited by friends and family members who may wish to encourage the patient or have a final visit before the patient passes. Therefore, these patients may desire to wear clothing which is more presentable and stylish than conventional medical garments while at the same time provides medical access to caregivers.

Therefore, a medical access shirt which enhances medical access to a patient such as a terminal patient while giving the patient a styled or dressed appearance to the patient is needed.

SUMMARY

The disclosure is generally directed to a medical access shirt which enhances medical access to a patient such as a terminal patient while giving the patient a styled or dressed appearance to the patient. An illustrative embodiment of the medical access shirt includes a shirt body having a pair of front shirt panels and a rear shirt panel carried by the front shirt panels and a generally elongated, rectangular rear shirt panel opening in the rear shirt panel.

In some embodiments, the medical access shirt may include a shirt body including pair of front shirt panels; a front shirt opening between the front shirt panels; and a rear shirt panel having a pair of shoulder panel portions and a pair of lower panel portions extending from the front shirt panels, respectively; and a generally elongated, rectangular rear shirt panel opening in the rear shirt panel.

In some embodiments, the medical access shirt may include a shirt body including a pair of front shirt panels; a front shirt opening between the front shirt panels; a rear shirt panel having a pair of shoulder panel portions and a pair of lower panel portions extending from the front shirt panels, respectively, and a shoulder connecting portion connecting the pair of shoulder panel portions; a generally elongated, rectangular, inverted U-shaped rear shirt panel opening defined by and between the lower panel portions, the shoulder panel portions and the shoulder connecting portion of the rear shirt panel; and a pair of rear shirt panel slits communicating with the rear shirt panel opening and dividing the lower panel portions from the shoulder panel portions, respectively, of the rear shirt panel; a pair of shirt sleeves carried by the front shirt panels, respectively, and the shoulder panel portions, respectively, of the shirt body; a pair of sleeve slits extending through and along the pair of shirt sleeves, respectively, and communicating with the pair of rear shirt panel slits, respectively; and a plurality of slit fasteners along the pair of rear shirt panel slits and the pair of sleeve slits.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, relative terms such as "upper", "lower", "front" and "back" are used to describe exemplary positions of various components relative to each other and shall not be construed in a limiting sense.

Figures 1, 2:
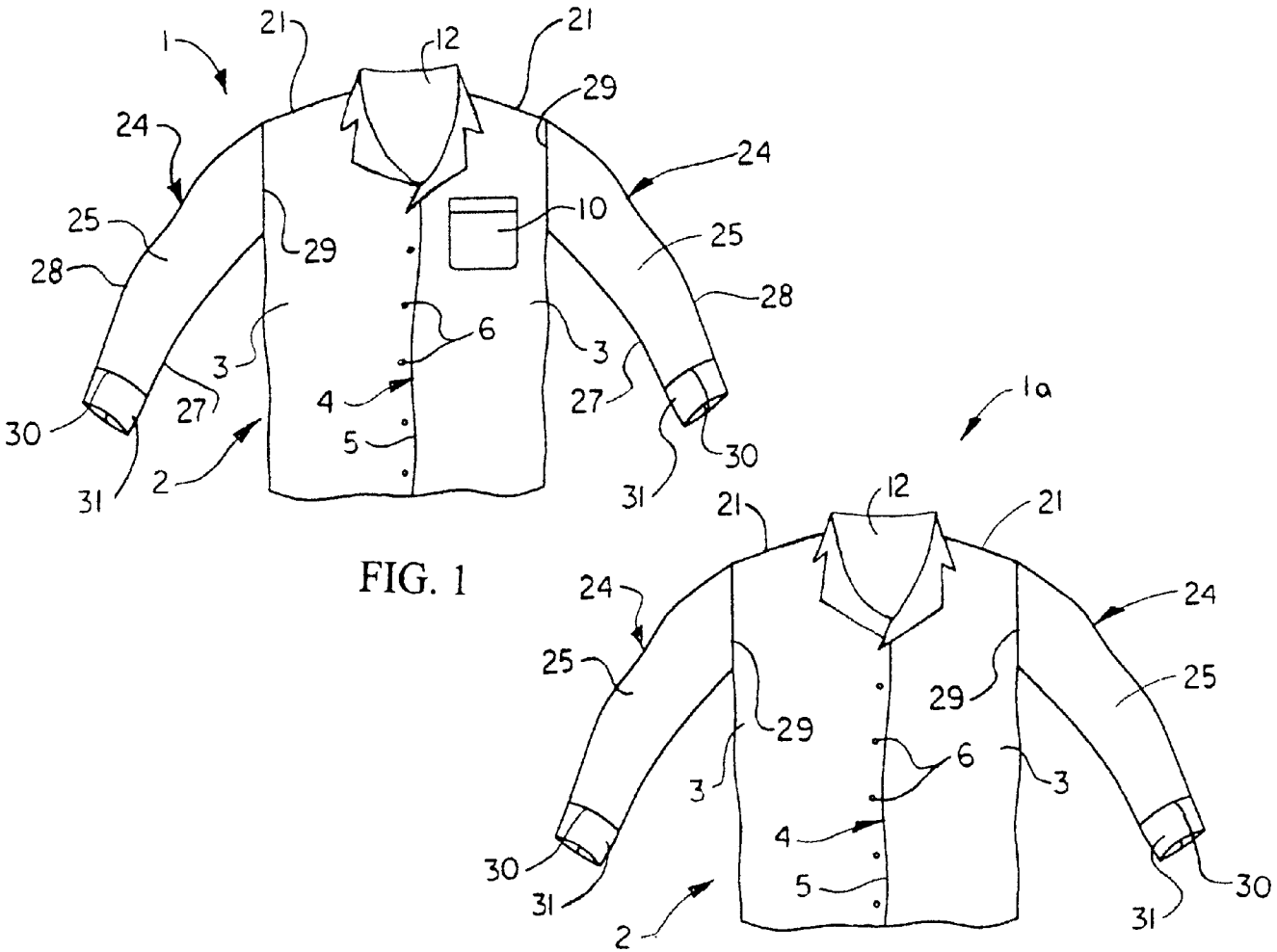
FIG. 1 is a front view of an illustrative embodiment of the medical access shirt.
FIG. 2 is a front view of an alternative illustrative embodiment of the medical access shirt.

Referring initially to FIGS. 1-8 of the drawings, an illustrative embodiment of the medical access shirt is generally indicated by reference numeral 1. The medical access shirt 1 includes a shirt body 2 which may be cotton, polyester, cotton/polyester blend or other material which is consistent with the functional requirements of the medical access shirt 1. As illustrated in FIG. 1, the shirt body 2 may include a pair of front shirt panels 3. A generally elongated, vertical front shirt opening 4 may separate or divide the front shirt panels 3. One of the front shirt panels 3 may have an exposed front shirt opening edge 5 extending along the front shirt opening 4. Front shirt fasteners 6 such as buttons or snaps, for example and without limitation, may be provided along the front shirt opening edge 5 to facilitate selective fastening and unfastening of the front shirt panels 3 at the front shirt opening 4.

As illustrated in FIG. 1, in some embodiments of the medical access shirt 1, a shirt pocket 10 may be provided on the exterior surface of one of the front shirt panels 3. The shirt pocket 10 may have any desired size and appearance or style. As illustrated in FIG. 2, in some embodiments of the medical access shirt 1*a*, the shirt pocket 10 may be omitted from the front shirt panel 3.

Figure 3:
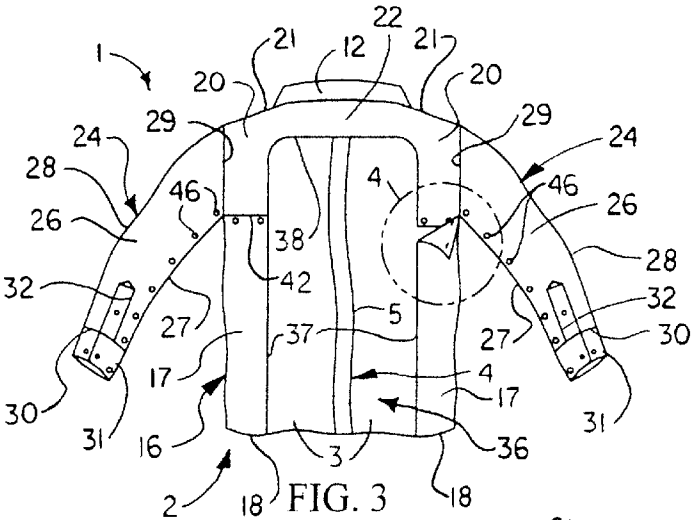
FIG. 3 is a rear view of an illustrative embodiment of the medical access shirt with a rear shirt panel slit in a partially-unfastened position.
Figure 4:
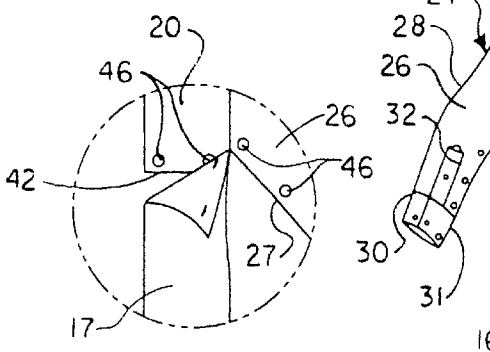
FIG. 4 is an enlarged sectional view taken along section line 4 in FIG. 3.

As illustrated in FIG. 3, the shirt body 2 may include a rear shirt panel 16. A rear shirt panel opening 36 which may be generally elongated and rectangular is provided in the rear shirt panel 16. The rear shirt panel opening 36 may have a generally inverted U-shaped configuration with a pair of generally elongated, parallel, spaced-apart side opening edges 37 and an upper opening edge 38 which extends between the side opening edges 37. Accordingly, the rear shirt panel 16 may include a pair of lower panel portions 17 and a pair of upper shoulder panel portions 20 on respective sides of the rear shirt panel opening 36. Each lower panel portion 17 may have a lower panel edge 18 and may be continuous with the front shirt panel 3 (FIG. 1) on the corresponding side of the shirt body 2. The shoulder panel portions 20 may be continuous with the respective front shirt panels 3 and form a pair of shirt shoulders 21 at the top of the shirt body 2. A shoulder connecting portion 22 may connect the shoulder panel portions 20 above the rear shirt panel opening 36. Therefore, the lower panel portions 17 and the shoulder panel portions 20 may form the side opening edges 37 and the shoulder connecting portion 22 may form the upper opening edge 38 of the rear shirt panel opening 36. A shirt collar 12 having a selected style may be provided on the shirt body 2 between the shirt shoulders 21.

A pair of shirt sleeves 24 extends from respective sides of the shirt body 2. Each shirt sleeve 24 may include a front sleeve portion 25 (FIG. 1), a rear sleeve portion 26 (FIG. 3), a lower sleeve portion 27 and an upper sleeve portion 28. Each shirt sleeve 24 may include a proximal sleeve end 29 which is sewn or otherwise attached to the front shirt panel 3 and the shoulder panel portion 20 on a corresponding side of the shirt body 2. A distal sleeve end 30 is opposite the proximal sleeve end 29 of the shirt sleeve 24. A sleeve cuff 31 may be provided at the distal sleeve end 30 of each shirt sleeve 24. A distal sleeve opening 32 may be provided in each sleeve cuff 31 and in the distal portion of each shirt sleeve 24.

Figure 5:
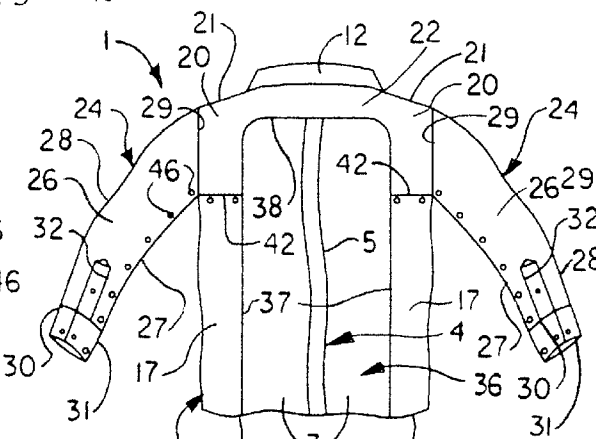
FIG. 5 is a rear view of an illustrative embodiment of the medical access shirt with the rear shirt panel slits completely fastened.
Figure 6:
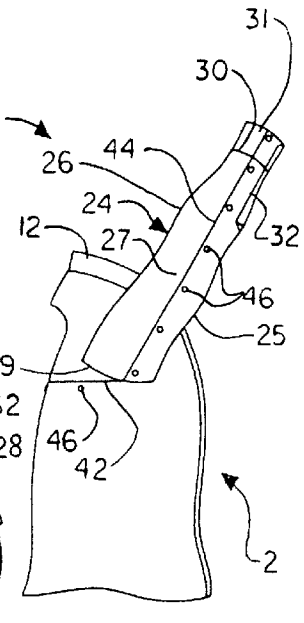
FIG. 6 is a side view of an illustrative embodiment of the medical access shirt.
Figure 8:
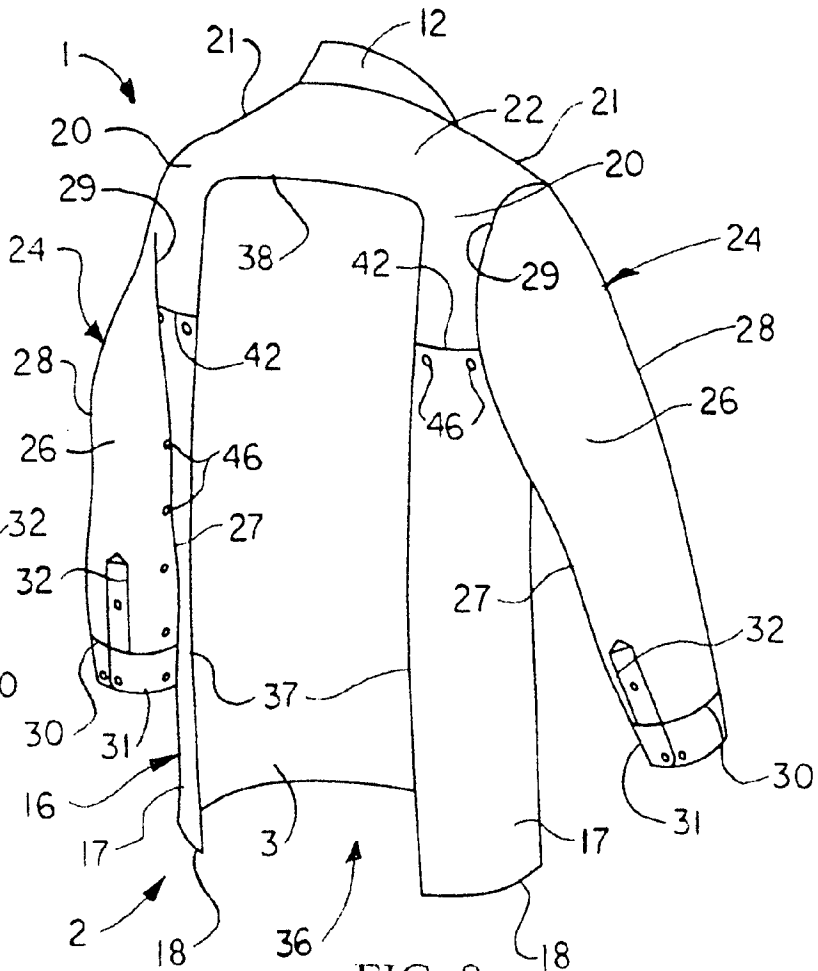
FIG. 8 is a rear perspective view of an illustrative embodiment of the medical access shirt.
Figure 7:
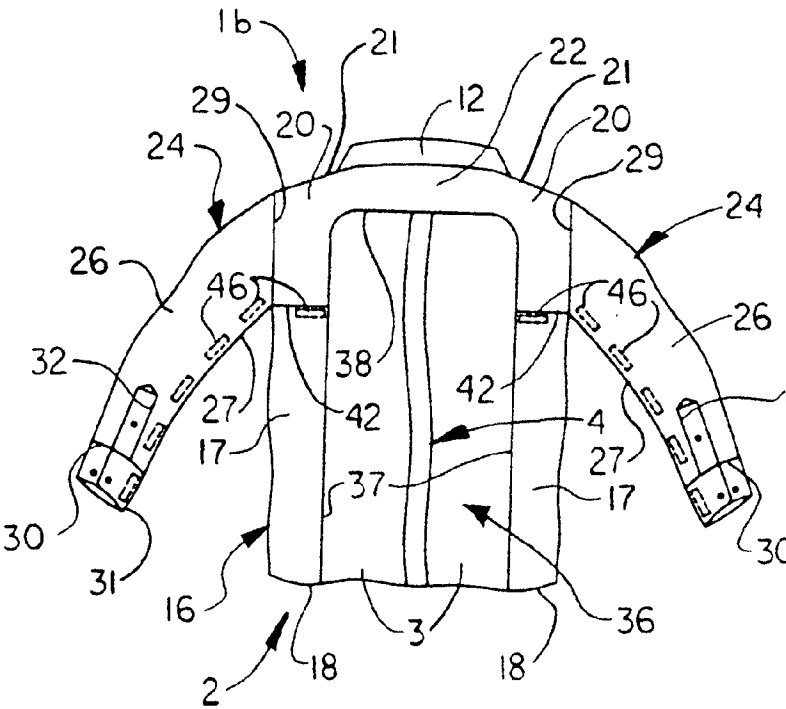
FIG. 7 is a rear view of another alternative illustrative embodiment of the medical access shirt.

As illustrated in FIGS. 3 and 5, a rear shirt panel slit 42 extends laterally through the rear shirt panel 16 from the rear shirt panel opening 36 to the proximal sleeve end 29 of each shirt sleeve 24. Each rear shirt panel slit 42 may communicate with the rear shirt panel opening 36 and separates the lower panel portion 17 from the shoulder panel portion 20 of the rear shirt panel 16 on the corresponding side of the shirt body 2. As illustrated in FIG. 6, a sleeve slit 44 extends through and along at least a portion of each shirt sleeve 24. The sleeve slit 44 may extend from the proximal sleeve end 29 through the distal sleeve end 30 and the sleeve cuff 31. In some embodiments, the sleeve slit 44 may extend through and along the lower sleeve portion 27 of the shirt sleeve 24, as illustrated in FIG. 6. In other embodiments, the sleeve slit 44 may extend through and along the rear sleeve portion 26 of the shirt sleeve 24. Accordingly, each sleeve slit 44 may communicate with the rear shirt panel slit 42 on the corresponding side of the shirt body 2. Slit fasteners 46 may be provided along and adjacent to each rear shirt panel slit 42 and each sleeve slit 44 to facilitate selective unfastening and fastening and opening and closing, respectively, of the rear shirt panel slit 42 and the sleeve slit 44, respectively. In some embodiments, the slit fasteners 46 may include snaps. In other embodiments, the slit fasteners 46 may include buttons. As illustrated in FIG. 7, in some embodiments of the medical shirt 1*b*, the slit fasteners 46 may include hook and loop fasteners. In still other embodiments, the slit fasteners 46 may be alternative type fasteners which are known by those skilled in the art.

In exemplary application, the medical access shirt 1 is donned by a terminal patient (not illustrated) typically by initially unfastening the front shirt fasteners 6 along the front shirt opening 4, extending the arms of the patient through the shirt sleeves 24 and fastening the front shirt fasteners 6 to close the front shirt opening 4. Accordingly, the front shirt panels 3 of the shirt body 2 cover the patient's chest and abdomen whereas the rear shirt panel 16 of the shirt body 2 generally covers the patient's back. The middle portion of the patient's back may remain exposed through the rear shirt panel opening 36 (FIG. 3). Moreover, the rear shirt panel slit or slits 42 and/or the sleeve slit or slits 44 (FIG. 6) may be selectively partially or completely opened by unfastening of all or selected ones of the slit fasteners 46. Therefore, the rear shirt panel opening 36, the rear shirt panel slits 42 and the sleeve slits 44 facilitate cleaning of the patient's torso and arms as well as routing of medical tubing (not illustrated) from the patient to intravenous drip bags or medical equipment (not illustrated) without the need to remove the medical access shirt 1 from the patient. Thus, throughout the cleaning and routing of medical tubing from the patient, the front of the medical access shirt 1 remains in place on the patient to give the patient a styled or dressed appearance for the benefit of persons who may visit the patient.

Figure 9:
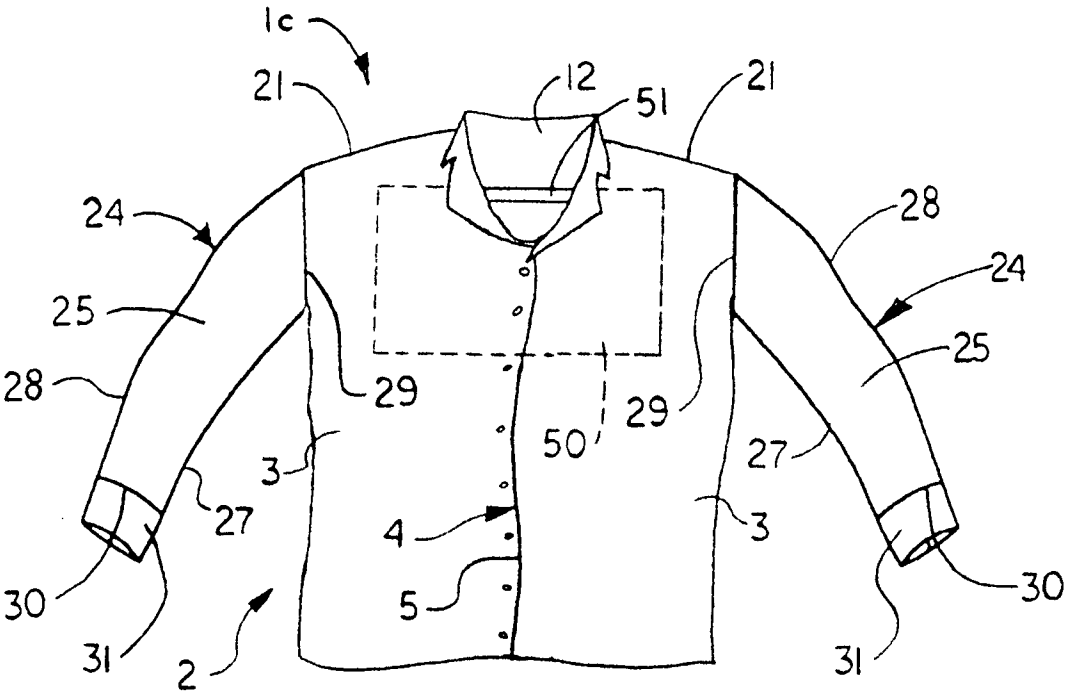
FIG. 9 is a front view of another alternative illustrative embodiment of the medical access shirt.

Referring next to FIG. 9 of the drawings, an alternative illustrative embodiment of the medical access shirt is generally indicated by reference numeral 1*c*. The medical access shirt 1*c* may include an undershirt panel 50 which may be generally rectangular and is sewn or otherwise attached to the interior surfaces of the front shirt panels 3 of the shirt body 2. Accordingly, the undershirt panel 50 spans the upper portion of the front shirt opening 4 beneath the shirt collar 12. The undershirt panel 50 includes an exposed panel portion 51 which is exposed through the front shirt opening 4 when the front shirt opening 4 is partially opened. Thus, the exposed panel portion 51 of the undershirt panel 50 imparts the appearance of an undershirt being worn beneath the medical access shirt 1*c* as the medical access shirt 1*c* is worn by a patient.

While illustrative embodiments of the disclosure have been described above, it will be recognized and understood that various modifications can be made in the disclosure and the appended claims are intended to cover all such modifications which may fall within the spirit and scope of the disclosure.

What is claimed is:

1. A medical access shirt, comprising:

a shirt body having a pair of front shirt panels and a rear shirt panel carried by the front shirt panels, the rear shirt panel including a pair of spaced-apart shoulder panel portions and a shoulder connecting portion connecting the shoulder panel portions, the spaced-apart shoulder panel portions each having a lower edge; and a pair of spaced-apart lower panel portions carried by the shoulder panel portions, respectively, the pair of spaced-apart lower panel portions each having an upper edge and a bottom edge; and a generally elongated, rectangular rear shirt panel opening in the rear shirt panel, the rear shirt panel opening having an upper opening portion between the shoulder panel portions and a lower opening portion between the lower panel portions, the lower opening portion communicating with the upper opening portion; and wherein the lower edges of the spaced-apart shoulder panel portions and the upper edges of the pair of spaced-apart lower panel portions define a pair of rear shirt panel slits therebetween.

2. The medical access shirt of claim 1 further comprising a pair of shirt sleeves carried by the shirt body.

3. The medical access shirt of claim 2 further comprising a pair of sleeve slits extending through and along at least a portion of the pair of shirt sleeves, respectively.

4. The medical access shirt of claim 3 wherein the pair of rear shirt panel slits in the rear shirt panel communicate with the rear shirt panel opening and communicate and are coincident with the pair of sleeve slits, respectively.

5. The medical access shirt of claim 4 further comprising a plurality of slit fasteners along the pair of sleeve slits and the pair of rear shirt panel slits.

6. The medical access shirt of claim 5 wherein the plurality of slit fasteners is a plurality of snaps, a plurality of buttons or a plurality of hook and loop fasteners.

7. The medical access shirt of claim 1 further comprising an undershirt panel carried by the pair of front shirt panels.

8. The medical access shirt of claim 1 wherein the rear shirt panel opening has a generally inverted U-shaped configuration.

9. A medical access shirt, comprising:

a shirt body including a pair of front shirt panels;

a front shirt opening between the front shirt panels;

a rear shirt panel having a pair of spaced-apart shoulder panel portions extending from the front shirt panels, respectively, a shoulder connecting portion connecting the shoulder panel portions and a pair of spaced-apart lower panel portions carried by the shoulder panel portions, respectively; and a generally elongated, rectangular rear shirt panel opening in the rear shirt panel, the rear shirt panel opening having an upper opening portion between the shoulder panel portions and a lower opening portion between the lower panel portions, the lower opening portion communicating with the upper opening portion; and a pair of shirt sleeves carried by the shirt body;

a pair of sleeve slits extending through and along at least a portion of the pair of shirt sleeves, respectively; and a pair of rear shirt panel slits in the rear shirt panel and communicating with the rear shirt panel opening and communicating and coincident with the pair of sleeve slits, respectively, the rear shirt panel slits dividing the lower panel portions from the shoulder panel portions, respectively, of the rear shirt panel.

10. The medical access shirt of claim 9 further comprising a plurality of slit fasteners along the pair of sleeve slits and the pair of rear shirt panel slits.

11. The medical access shirt of claim 10 wherein the plurality of slit fasteners is a plurality of snaps, a plurality of buttons or a plurality of hook and loop fasteners.

12. The medical access shirt of claim 9 further comprising an undershirt panel carried by the pair of front shirt panels and having an exposed panel portion exposed through the front shirt opening.

13. The medical access shirt of claim 9 wherein the rear shirt panel opening has a generally inverted U-shaped configuration.

14. A medical access shirt, comprising:

a shirt body including a pair of front shirt panels;

a front shirt opening between the front shirt panels;

a rear shirt panel having a pair of spaced-apart shoulder panel portions extending from the front shirt panels, respectively, and a pair of spaced-apart lower panel portions carried by the shoulder panel portions, respectively, and a shoulder connecting portion connecting the pair of shoulder panel portions;

a generally elongated, rectangular, inverted U-shaped rear shirt panel opening defined by and between the lower panel portions, the shoulder panel portions and the shoulder connecting portion of the rear shirt panel, the rear shirt panel opening having an upper opening portion between the shoulder panel portions and a lower opening portion between the lower panel portions, the lower opening portion communicating with the upper opening portion;

the shoulder connecting portion maintains the shoulder panel portions and the lower panel portions of the rear shirt panel in parallel, spaced-apart and unfastenable relationship to each other on respective sides of the rear shirt panel opening; and a pair of rear shirt panel slits communicating with the rear shirt panel opening and dividing the lower panel portions from the shoulder panel portions, respectively, of the rear shirt panel; and a pair of shirt sleeves carried by the front shirt panels, respectively, and the shoulder panel portions, respectively, of the shirt body;

a pair of sleeve slits extending through and along the pair of shirt sleeves, respectively, and communicating and coincident with the pair of rear shirt panel slits, respectively; and a plurality of slit fasteners along the pair of rear shirt panel slits and the pair of sleeve slits.

15. The medical access shirt of claim 14 wherein each of the shirt sleeves comprises a front sleeve portion, a rear sleeve portion opposite the front sleeve portion, a lower sleeve portion between the front sleeve portion and the rear sleeve portion and an upper sleeve portion opposite the lower sleeve portion, a proximal sleeve end carried by the shirt body and a distal sleeve end opposite the proximal sleeve end, and wherein each of the pair of sleeve slits extends generally through and along the lower sleeve portion from the proximal sleeve end through the distal sleeve end of a corresponding one of the pair of shirt sleeves.

16. The medical access shirt of claim 14 wherein the plurality of slit fasteners is a plurality of snaps, a plurality of buttons or a plurality of hook and loop fasteners.

17. The medical access shirt of claim 14 further comprising an undershirt panel carried by the pair of front shirt panels and having an exposed panel portion exposed through the front shirt opening.

* * * * *